United States Patent [19]

Gundlach

[11] 3,941,280

[45] Mar. 2, 1976

[54] APPARATUS FOR CONTROLLING DEVELOPER EFFICIENCY

[75] Inventor: Robert W. Gundlach, Victor, N.Y.

[73] Assignee: Xerox Corporation, Stamford, Conn.

[22] Filed: Feb. 13, 1974

[21] Appl. No.: 442,292

[52] U.S. Cl. ..... 222/52; 222/DIG. 1

[51] Int. Cl.[2] ..... B67D 5/08

[58] Field of Search ..... 222/DIG. 1, 52; 355/16, 355/14, 3, 3 DD; 118/7, 8, 637

[56] References Cited

UNITED STATES PATENTS

| | | | |
|---|---|---|---|
| 3,066,298 | 11/1962 | McNaney | 355/16 X |
| 3,094,049 | 6/1963 | Snelling | 355/3 DD |
| 3,533,692 | 10/1970 | Blanchette et al. | 355/16 |
| 3,553,464 | 1/1971 | Abe | 250/325 |
| 3,682,538 | 8/1972 | Cade et al. | 355/3 DD |
| 3,776,630 | 12/1973 | Ohno et al. | 355/16 X |
| 3,777,173 | 12/1973 | Landrith | 222/DIG. 1 X |
| 3,778,841 | 12/1973 | Gundlach et al. | 355/16 X |
| 3,797,926 | 3/1974 | Fotland et al. | 355/16 X |
| 3,834,809 | 9/1974 | Yoshizawa et al. | 355/3 DD X |

*Primary Examiner*—Robert B. Reeves
*Assistant Examiner*—Charles A. Marmor

[57] ABSTRACT

Apparatus for controlling developer efficiency in an electrostatic copying machine. A thin film of semi-insulating material is positioned for advancement through a development zone indicative of the quality of a developer system. Positioned in the path of the film and in the vicinity of the development zone are a plurality of conductive members which are coupled to sources of potential having a difference in voltage of approximately 200 to 600 volts in one embodiment. The difference in potential cause the development along the semi-insulating film material where the electrostatic fields are greatest. The film is then advanced past a detection station which includes an optical sensing device for sensing the transmission of the film and supplying signals indicative of the transmission characteristics to a control circuit which controls the toner dispensing in the developer system. In an alternative embodiment three conductive members may be used in place of the two conductive members with the middle conductive member being at one electric potential and the outer conductive member being at a second potential.

4 Claims, 2 Drawing Figures

APPARATUS FOR CONTROLLING DEVELOPER EFFICIENCY

The present invention relates to elecrostatic copying machines and in particular to an apparatus for controlling the developer efficiency in an electrostatic copying machine.

It is well known that in electrostatic copying machines that there are varying toner consumptions due to varying electrostatic contrasts and image areas from one copy to another and that with variations in optimum toner concentration for various humidities, developer age, etc. that it is extremely important that the copier have a controlled developer system if the output quality is to remain at a consistently high level. In the past there have been various techniques for detecting or sensing the efficiency of the developer system response. Some devices are highly complex and others require alteration of components normally used in the electrostatic copying machine. Still other attempts have been made at detecting the efficiency of the developer by corona charging and then developing a web or belt which is then measured as described for example in U.S. Pat. No. 3,553,464. The present invention is an improvement over the existing devices and the foregoing patent in the sense that it is extremely reliable in establishing a development characteristic of the development system which is being controlled. Furthermore, it does not require any alteration in the electrostatic copying machine of existing parts or components.

It is therefore an object of the invention to control the developer efficiency of an electrostatic copying machine.

It is a further object of the present invention to control toner consumption of a developer system irrespective of variations in humidity, developer age and other factors which contribute to the desired concentration of toner.

It is a further object of the present invention to obtain a quality of copies which remains at a consistant high level.

Figure 1:
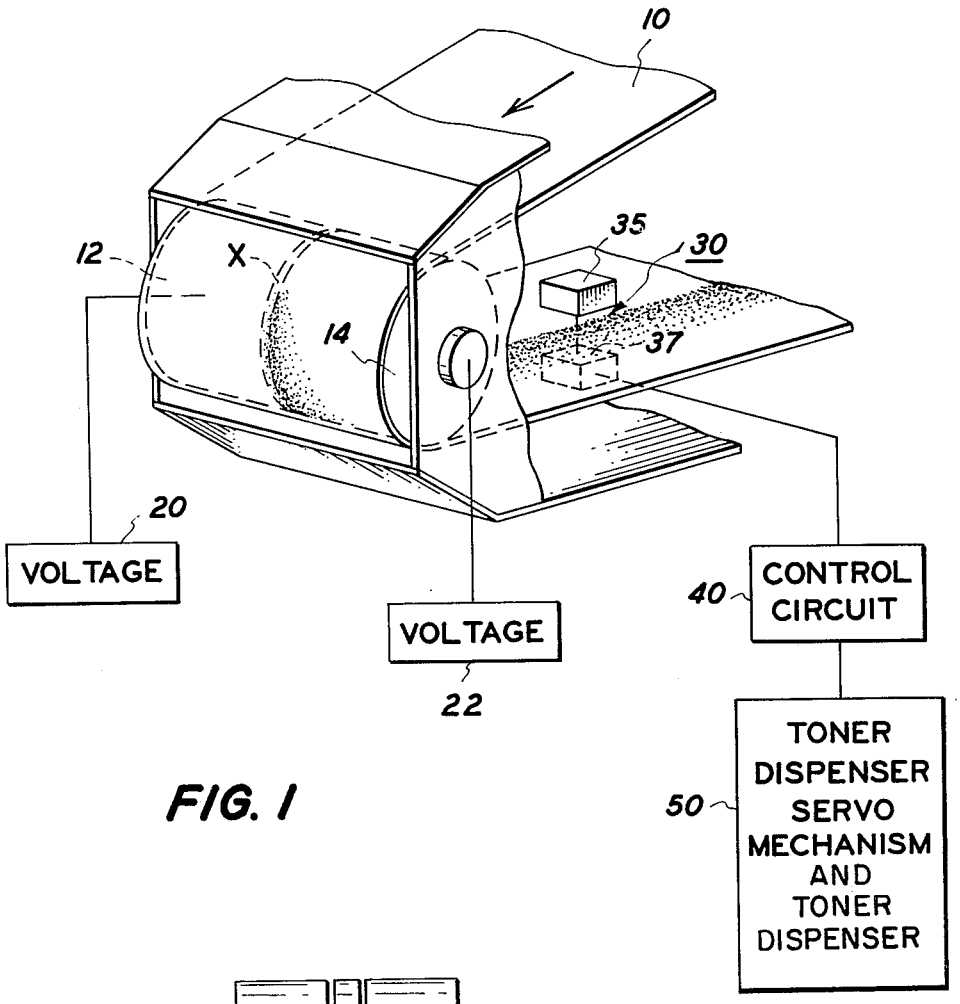
Figure 2:
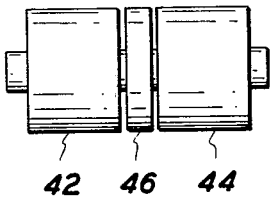

For a better understanding of the invention reference is made to the following detailed disclosure of this invention taken in conjunction with the accompanying drawings in which:

FIG. 1 is an isometric view of the invention illustrating one embodiment thereof, and FIG. 2 is a partial view indicating another embodiment of the invention.

As shown in FIG. 1 a thin transparent or translucent film of semi-insulating material designated 10 is developed by a representative sample of developer material in the vicinity of co-planar electrodes or ring members 12 and 14. The co-planar electrodes may take the form of a cylinder which is coated with a conductive material which coating is separated by about a spaced distance *x* of about 5 to 50 mils. A source of potential 20 is coupled to conductive ring member 12 and another source of potential 22 is coupled to conductive ring member 14. The potential difference of the two conductive ring members is approximately 200 to about 600 volts. It will be understood that either of the potentials can be ground potential. It will be appreciated that the semi-insulating film material which is threaded to ride taut over the cylinder is exposed to the developer material and developed by interposition development techniques known by those skilled in the art with a representative sample of the developer material in the developer system of the electrostatic copying machine.

For interposition development film thickness desirably is about ¼ to 4 mils or about 6 to 100 microns. Surface resistivity should be greater than about $10^{13}$ ohms/square. Any suitable semi-insulating transparent or translucent material can be used. Preferred materials are Tedlar and Mylar, trademarks of duPont Corporation, Wilmington, Del., polyethylene, polypropylene and mixtures thereof.

After development occurs at the boundary the semi-insulating film 10 is advanced past a window area 30 which is positioned to intercept the line of maximum toner disposition. A lamp 35 and a photocell 37 are arranged to measure the optical transmission density of the tape at the window area 30. A control circuit 40 is coupled to the photocell 37 for supplying signals to the toner dispenser servomechanism and toner dispenser 50 for controlling the efficiency of the developer quality in a manner well known by those skilled in the art. The speed of the film advance and the position of the window area 30 is selected so that no more than a few copies are made before the toner dispensing mechanism responds to the condition of the developer.

It will now be appreciated that by the above described invention that the developer efficiency is controlled at all times irrespective of variations in the optimum toner concentration from one copy to another and with various humidities, developer age, etc.

In a second embodiment as shown in FIG. 2 three conductive cylinder members are used in place of the two as shown in FIG. 1. Cyliner members 42 and 44 are coupled to one voltage level and cylindrical member 46 is coupled to a second voltage level. In this embodiment the potentials are selected so that development will occur in vicinity of cylindrical member 46. It should be understood that either of the potential sources can be ground potential.

While there have been shown and described and pointed out the fundamental novel features of the invention as applied to a preferred embodiment, it will be understood that various omissions and substitutions and changes in the form and details of the device illustrated and in its operation may be made by those skilled in the art without departing from the spirit of the invention.

What is claimed is:

1. Apparatus for controlling developer efficiency in an electrostatic copying machine comprising:

a thin film of semi-insulating translucent material positioned for advancement through a development zone indicative of the quality of a developer system, a plurality of conductive members each member being positioned in the path of the film on one side thereof in contact therewith in the vicinity of the development zone, said conductive members each being coupled to a different source of potential having a difference of from about 200 volts to about 600 volts to cause development of the film only at the vicinity where potential difference is greatest, said conductive members being spaced apart by a distance from about 5 to about 50 mils, detection means for sensing the optical transmission of the film where development occurs where potential difference is greatest and supplying electrical signals for controlling toner dispensing in the developer system, and toner dispensing means for dispensing toner at a predetermined rate in response to control signals, control means responsive to electrical signals from said detection means to generate signals to actuate said toner dispensing means.

2. Apparatus according to claim 1 wherein said film material has a thickness ranging from about .25 to about 4 mils and a surface resistivity greater than about $10^{13}$ ohms/square.

3. Apparatus according to claim 2 wherein said film material is transparent.

4. Apparatus according to claim 2 wherein said conductive members comprise at least three elements, two elements being coupled to one voltage level and the third element being coupled to a second voltage level.

* * * * *